United States Patent [19]

Fuller

[11] Patent Number: 4,795,092

[45] Date of Patent: Jan. 3, 1989

[54] LAMINAR FLOW NOZZLE

[75] Inventor: Mark Fuller, Studio City, Calif.

[73] Assignee: Wet Enterprises, Inc., Burbank, Calif.

[21] Appl. No.: 69,300

[22] Filed: Jul. 2, 1987

Related U.S. Application Data

[63] Continuation of Ser. No. 800,224, Nov. 25, 1985, abandoned.

[51] Int. Cl.[4] ..... B05B 17/04; B05B 17/08

[52] U.S. Cl. ..... 239/12; 239/23; 239/124; 239/462; 239/590.3; 239/590.5; 239/DIG. 1

[58] Field of Search ..... 239/461, 462, 428.5, 239/7, 11, 12, 590, 590.3, 590.5, 16–23, 553, 553.3, 553.5, 124, DIG. 1

[56] References Cited

U.S. PATENT DOCUMENTS

| | | | |
|---|---|---|---|
| 2,551,699 | 5/1951 | Parks | 239/462 |
| 2,633,908 | 4/1953 | Brierly | 239/553.3 |
| 2,995,309 | 8/1961 | Moen | 239/428.5 |
| 3,630,444 | 12/1971 | Nelson | 239/590.3 |
| 3,730,440 | 5/1973 | Parkison | 239/590.5 |
| 3,773,258 | 11/1973 | Hruby, Jr. | 239/17 |
| 3,782,629 | 1/1974 | Hruby, Jr. | 239/17 |
| 4,354,635 | 10/1982 | Barnert et al. | 239/590.3 |

*Primary Examiner*—Douglas C. Butler
*Assistant Examiner*—Michael J. Forman
*Attorney, Agent, or Firm*—Blakely, Sokoloff, Taylor & Zafman

[57] ABSTRACT

The present invention provides a means for producing a laminar output of fluid which is substantially turbulence free. The present invention utilizes an input tank or enclosure which includes turbulence reducing and flow straightening devices for producing a turbulent free output flow of water. This enclosure uses a tangential input port to introduce water to the enclosures which results in much more uniform and controllable flow profiles of the water through the device. The entire device may be situated entirely beneath the surface of a pool, pond or fountain, with a clear glass or plastic tube extending above the water level to provide a visibly nonintrusive protective path for the laminar output flow.

11 Claims, 4 Drawing Sheets

LAMINAR FLOW NOZZLE

This is a continuation of application Ser. No. 06/800,224, filed 11/25/85 now abandoned.

BACKGROUND OF THE INVENTION

1. Field of the Invention.

This invention relates to the field of fluid flow devices, and more particular, to nozzles which generate a laminar discharge of fluid.

2. Prior Art.

It is often desired to utilize a fluid, such as water, as part of a display or attraction. For example, various types of fountains adorn public and private plazas, parks, advertisements, and amusement parks. As part of these displays, it may be desired to produce a smooth, laminar flow of water which gives the appearance of a solid glass or clear plastic rod.

In the past, various methods have been used to provide a laminar stream of water. For example, Wilson, U.S. Pat. No. 2,432,641 discloses a dispensing nozzle which includes a cylindrical member having semicircular channels formed on the inside face for reducing the turbulence of fluids, such as gasoline. Jeffras et al, U.S. Pat. No. 4,393,991, discloses a sonic water jet nozzle which utilizes an elongated conical nozzle which includes fin-like members to reduce the turbulence of the water and to produce a laminar flow of water. Parkison et al, U.S. Pat. No. 3,321,140, discloses an attachment for a faucet which utilizes a series of fins in a cylindrical nozzle for producing a laminar flow of water to reduce the splash on the bottom of a sink or tub. Barker, U.S. Pat. No. 2,054,964, discloses a fluid discharge device which uses a series of parallel plates providing channels parallel to the flow of the fluid to facilitate the discharging of a smooth stream of water. Watts, U.S. Pat. No. 2,408,588, discloses a method of producing columnar flow of an oxidizing gas to be used in dividing or desurfacing metal. Watts utilizes a passage having a cross section which is noncircular, such as eliptical, triangular or square. Parkison, U.S. Pat. No. 3,730,440, teaches a laminar flow spout which utilizes a plurality of independent nozzles arranged within a single spout which results in a plurality of streams having laminar flow characteristics.

Other methods which have been utilized to obtain laminar flow of fluids include the use of curved perforated disks inserted in the nozzle to produce a splashless laminar output, such as in Parkison et al, U.S. Pat. Nos. 3,851,825; Nelson, 3,630,444; and Parkison, 3,730,439. Nel, U.S. Pat. No. 4,119,276, utilizes a plurality of straight, perforated screens having varying degrees of perforation to provide a splash free, clear, laminar output.

Although these prior methods are useful in reducing the amount of turbulence in streams of water, none of the methods is suitable in providing a fountain display in which substantially all of the turbulence is eliminated from a columnar stream of water. One disadvantage of these prior methods is the introduction of turbulence immediately prior to the nozzle. Each method cited above uses axial or radial water intake to the nozzle region. Such a method produces a great deal of turbulence in the fluid just upstream of the nozzle. For example, when an axial intake is used, the water entering the nozzle from the intake is meeting water which is stationary or is moving in a direction opposite that of the intake stream. This creates a turbulence profile at this interface so that the turbulence profile of the water passing through the nozzle region is not uniform. As a result, eddies and turbulences are carried through the nozzle system and result in an output which includes undulations, splashing, and ripples.

Likewise, an axial intake creates a turbulence profile immediately downstream of the nozzle system which is non-uniform. This also introduces unwanted turbulence into the final output stream of water.

Therefore, it is the object of the present invention to provide a means for producing a laminar fluid output stream having substantially no turbulence.

It is a further object on the present invention to provide a means for further providing a laminar output fluid flow nozzle in which fluid having a uniform turbulence profile is presented to the nozzle region.

It is yet another object of the present invention to provide an improved laminar output nozzle.

BRIEF SUMMARY OF THE INVENTION

The present invention provides a means for producing a laminar output of fluid which is substantially turbulence free. The present invention utilizes an input tank or enclosure which includes turbulence reducing and flow straightening devices for producing a turbulent free output flow of water. This enclosure uses a tangential input port to introduce water to the enclosures which results in much more uniform and controllable flow profiles of the water through the device. The entire device may be situated entirely beneath the surface of a pool, pond or fountain, with a clear glass or plastic tube extending above the water level to provide a visibly nonintrusive protective path for the laminar output flow.

DETAILED DESCRIPTION OF THE INVENTION

Figure 1:
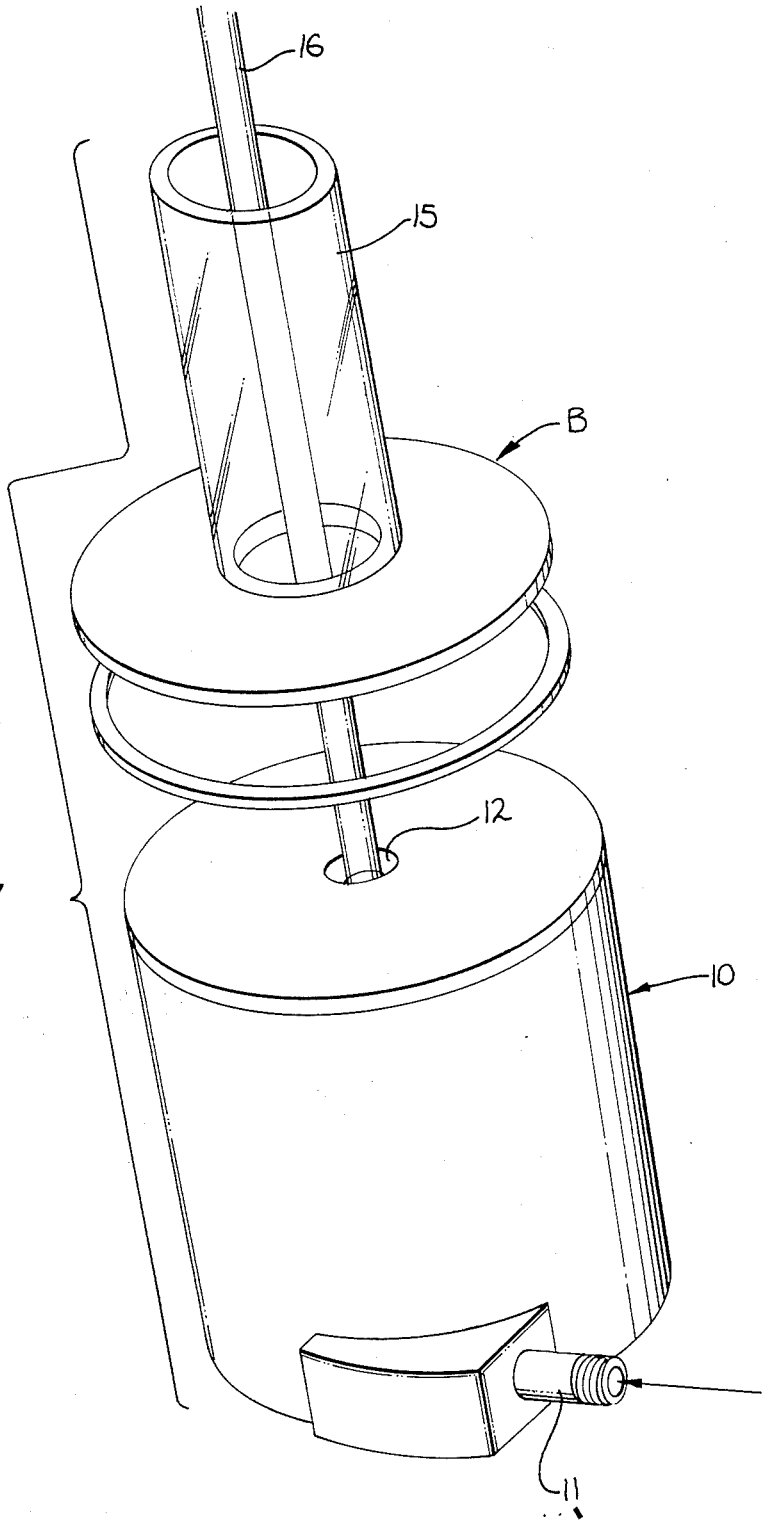
FIG. 1 is a perspective view of the present invention.

First referring to FIG. 1, a perspective view of the present invention may be seen. The present invention consists of an input tank or chamber 10 having a substantially tangential water input line 11 at one end thereof, an exit orifice 12 at the other end thereof, and containing turbulence reducing means for substantially eliminating turbulence in the flow therethrough, to provide a laminar flow which will remain laminar when forced through the exit orifice 12 of the tank to provide the glass-like rod of water desired.

The turbulence reducing means may be any suitable means, such as by way of example, are well known in the prior art. By way of specific example, a plurality of screens, a plurality of channels, or combinations thereof may be used. The purpose of the turbulence reducing means is to provide relatively small flow passages therethrough to reduce the Reynolds number of the flow to a value or values well below the Reynolds number at which the flow goes turbulent. In particular, the Reynolds number is given by the following equation $$Re = \frac{\rho VD}{\mu}$$

where

Re=Reynolds number $\rho$=density v=velocity d=diameter of the opening through which the stream passes; and $\mu$=viscosity of the fluid In general, if the Reynolds number of the flow is less than approximately 500, a fully developed flow will be laminar, and if the injected flow into the low Reynolds number region is turbulent, the flow will settle toward and develop into laminar flow as it progresses through the low Reynolds number region. If on the other hand the Reynolds number is larger than approximately 2000, fully developed flow in the high Reynolds number region will be turbulent, and even if the flow injected into the high Reynolds number region is laminar, it will go turbulent as it progresses through the high Reynolds number region. The foregoing Reynolds numbers are approximate of course, with the flow at intermediate Reynolds numbers depending on various factors such as initial conditions, surface roughness, etc. The ultimate result desired, of course, is to establish laminar flow in the tank 10, and to maintain the flow laminar even in the outlet stream 16. Since laminar flow is characterized by smooth and parallel streamlines in the flow, a laminar stream 16 will have a cross section duplicating the shape of orifice 12, thereby having a glass rod-like appearance using a round orifice.

Since the density and viscosity of water are substantially fixed, the velocity and diameter in the turbulence reducing means must be kept low to reduce the Reynolds number to the desired level. The effective velocity through the turbulence reducing means may be made relatively low by using a tank 10 of adequate diameter, giving due regard to the percentage fill of the material forming the turbulence reducing means. By proper selection of the materials used, the effective diameter of the flow passages can be readily selected which, together with the relatively low velocity, will provide the desired laminar, turbulent free output. For instance, using a plurality of screens each having a large number of small diameter openings, a plurality of streams, each having a low Reynold's number in the individual streams, results in the desired laminar output. Also, as an alternative, use of a plurality of channels such as provided by a stack of small tubes also provides the desired laminar flow.

The holding tank or chamber in the preferred embodiment is generally cylindrical and is made watertight so that it may be pressurized from the inlet 11 as required to provide the desired velocity in the output stream 16 emitted from the orifice 12. In that regard, in many applications it may be desired to have as much of the system positioned as much out of sight as possible, and for this purpose an optional cover 13 with extension 15 provides protection for the stream 16 to the top of the extension. In other applications it may be desired to place the laminar flow nozzle in or below a water pool in which case extension 15 would extend to a level just above the surface of the water. This, coupled with the fact that at least extension 15 is fabricated of clear plastic, makes the entire apparatus as unobtrusive as possible.

Figure 2:
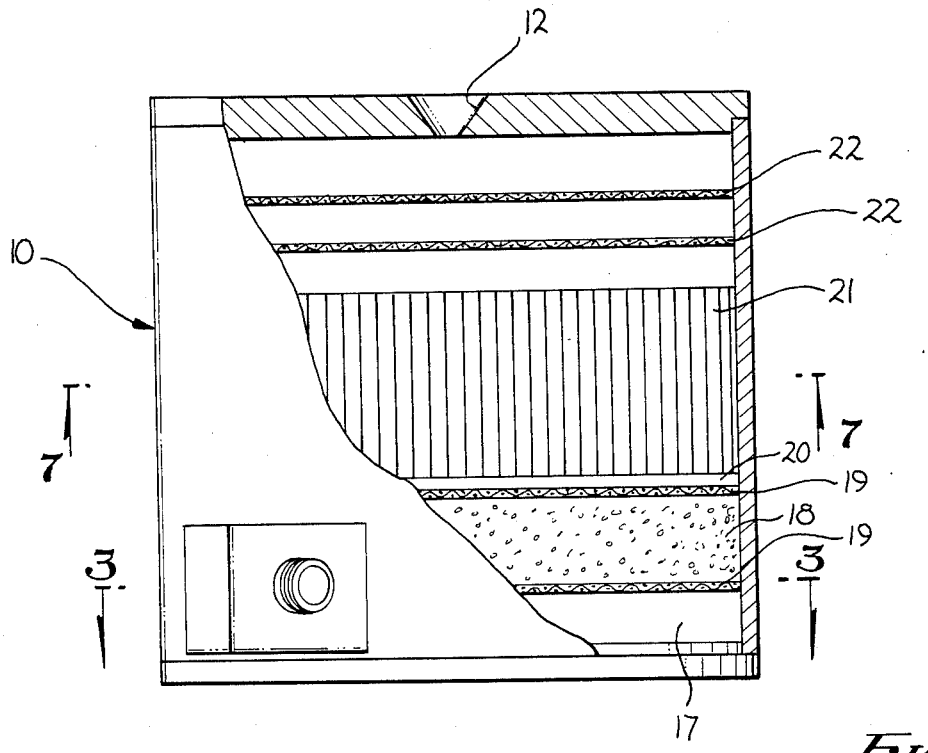
FIG. 2 is a side view of the holding tank of the present invention illustrating the output orifice and filter means.
Figure 3:
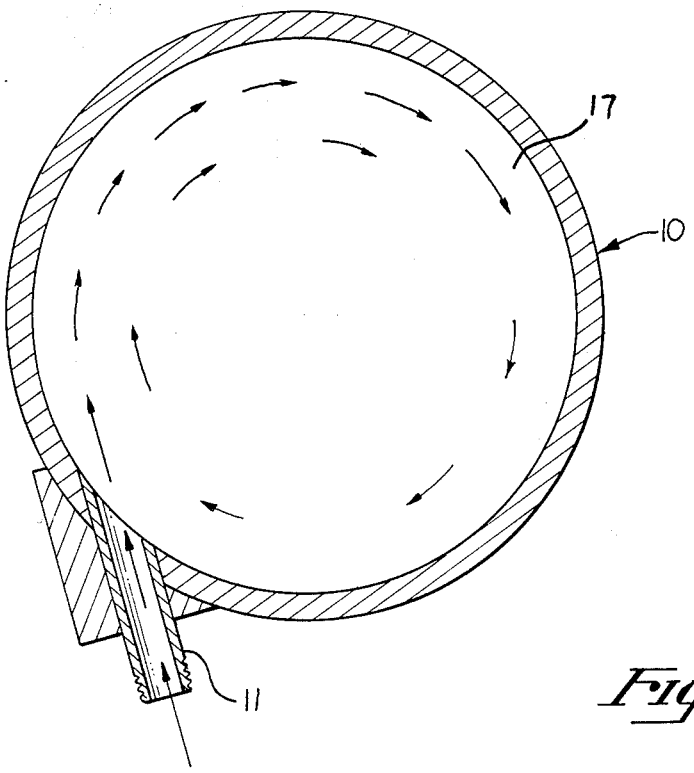
FIG. 3 is a flow diagram illustrating the fluid flow pattern of the present invention.

Now referring to FIGS. 2 and 3, a side view, partially cut away, of the preferred embodiment of the present invention and a cross section thereof taken along line 3—3 of FIG. 2 may be seen. As shown in FIG. 3, water is injected into the plenum region 19 through line 11 in a substantially tangential manner, which of course creates a swirl illustrated by the arrows in FIG. 3. The tangential introduction of the water however, makes that swirl relatively uniform, and in itself does not create any axial component of water flow, or more importantly, create or induce any nonuniform axial component of waterflow due to the water introduction alone.

Positioned above the plenum 17 is an open cell foam member 18 of reasonably small cell size. The foam preferably is a relatively rigid foam so as to not distort or collapse when experiencing any dynamic water pressures, though for foam retention, perforated metal screens 19 are provided on each side of the foam. Located above the foam is a smaller plenum or flow development chamber 20, above which is a stack of small tubular members generally indicated by the numeral 21, defining small diameter and small effective diameter flow passages therethrough and therebetween In that regard a cross section through the stack of tubular members 21 showing the individual tubes 26 may be seen in FIG. 7. These tubular members may be plastic members bonded together with an appropriate cement, or more conveniently, solvent welded by temporarily retaining the stack of tubular members and dipping the stack in suitable solvent for a very short time. Obviously the tubular members may also be other materials or retained in position by other methods, or in fact could be shapes other than circular in cross section, though the solvent welding of thin walled plastic tubes is particularly easy and inexpensive and provides a nice rigid assembly without disturbing the regularity of the flow passages therethrough. Above the assembly 21 is an additional space having a pair of profile flattening screen 22 therein.

Figure 7:
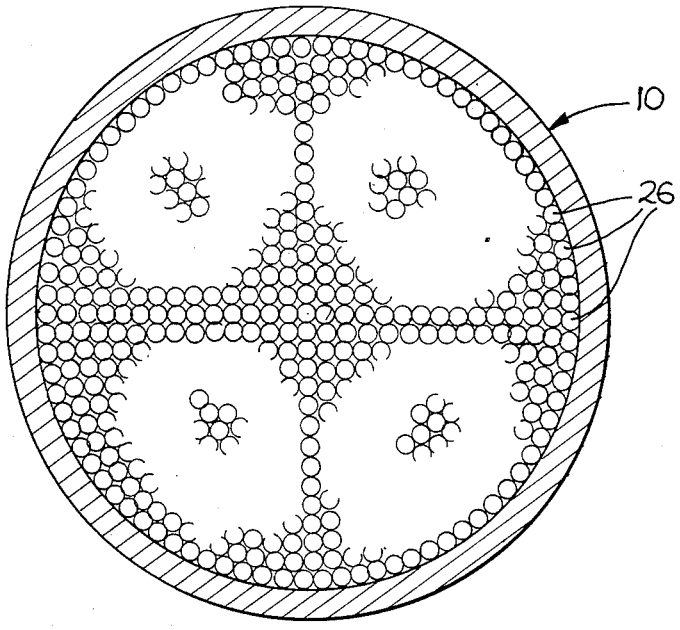
FIG. 7 is a cross sectional view of the flow tube assembly of the present invention.

The operation of the structure described with respect to FIGS. 2, 3 and 7 is as follows:

Water injected into the plenum 17 will result in the swirling motion indicated in FIG. 3, with the angular rate of that rotation being greater toward the center of the chamber than at the periphery, as in ordinary eddies As additional water is injected, the swirling water will rise to pass through the foam member 18 at the top of the plenum. The foam member, having relatively small circuitous paths therethrough, will allow the flow to drift upward therethrough relatively uniformly over the area of the foam member, but will provide a very high restriction and very large viscous surfaces to any flow in a tangential direction. Accordingly, the bulk tangential or swirling flow shown in FIG. 3 is totally broken up as the water begins to move through the foam member. Also, while the flow through the cells could have a swirling motion within the cell size (e.g., the single large eddy broken up into many very small eddies), the viscous surface to volume of water in a cell is so large that the rotational flow within the cells will be quickly dissipated as a result of the viscous energy losses Further, the irregularity of the interconnection of the open cells continually breaks up even the small eddies, so that the flow emerging from the top of the foam member 18 is relatively uniform in vertical velocity component across the area of the foam member, and is substantially free of all rotational effects, being disturbed only slightly by the irregularity in the surface of the foam and the upper screen 19.

The small chamber 20 above the foam member acts as a flow development chamber, allowing a space within which these small disturbances will die out to develop a substantially uniform vertical flow in chamber 20 substantially free of any rotational flow therein The Reynolds number in this chamber obviously is relatively high, as the chamber diameter is relatively large, though before any development of turbulent flow therein, the flow will enter the flow straightening stack or assembly 21 wherein the Reynolds number again will be very low. The assembly 21 will further suppress any rotational effects and in general will result in rather fully developed laminar flow in each of the passage ways, e.g., the flow exiting from any passage will have a maximum velocity at the center of area of the passage, with the velocity profile parabolically reducing to zero at the surfaces or edges of the passageway. Consequently, the flow emerging from assembly 21 and progressing toward the profile flattening screens 22 will on an average basis have a relatively uniform vertical velocity across the area of the assembly, though very locally will have higher values in the shadow of the center of the passage ways than in the shadow of the edges of the passage ways. The profile flattening screens 22 effectively flatten that local profile by providing more restriction on the higher velocity water therethrough than the neighboring lower velocity water, so that the water exiting from the top of the upper screen 22 and progressing through the small flow development chamber thereabove is substantially free of all flow disturbances. Consequently, the water forced outward through the orifice 12 will be laminar and substantially free of all disturbances so as to provide a glass rod-like stream 16 (see FIG. 1) having much lower disturbances therein and accordingly, a much better glass rod-like appearance than for prior art laminar flow nozzles.

Figure 5:
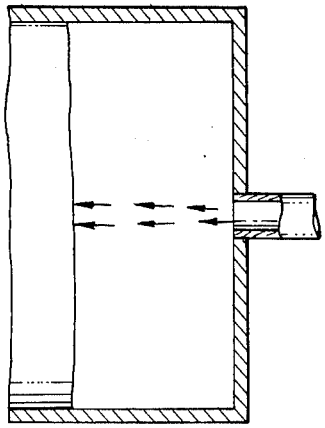
Fig. 5 PRIOR ART
FIG. 5 is a flow diagram illustrating the fluid flow pattern of one prior art holding tank.
Figure 6:
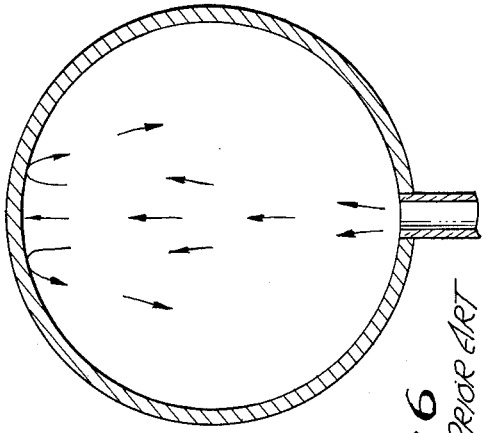
Fig. 6 PRIOR ART
FIG. 6 is a flow diagram illustrating the fluid flow pattern of another prior art holding tank.

As previously explained, the prior art has included laminar flow nozzles having an axial injection of water and nozzles having a radial injection of water, as illustrated diagrammatically in FIGS. 5 and 6. It has been found however, that the tangential injection of water as in the present invention provides far improved results over the prior art, both in the lack of turbulence within the water stream, and the absence of low frequency undulations in the entire stream. While there may be various reasons for this, the testing of the present invention has illustrated that there are certain factors which may not heretofore have been recognized or considered In particular, the axial injection of water as in FIG. 5 immediately results in much higher velocity axial flow through the center of a nozzle assembly than at the sides The net result of this is that the time the flow is resident in the flow straightening and rotational flow removing elements of the nozzle is grossly reduced, thereby reducing the effectiveness of these components, as their ability to dissipate disturbances tends to be strongly resident time related On the other hand, the radial injection of FIG. 6 also results in relatively nonuniform vertical flow from the injection region, with similar results as that of the axial injection of FIG. 5. Both of these forms of injection also would appear to cause relatively local disturbances, small but strong eddies, etc., which by their nature have a greater ability to survive when passing through screens, small tubes, etc., than a single large eddy as generated by the present invention and illustrated in FIG. 3. Finally, an apparent factor which does not appear to have been heretofore considered is the piping arrangement providing the flow to the laminar flow nozzle, whether injected as in the present invention or as in the prior art. In particular, normally the piping providing the source of water will contain elbows not too distant from the nozzle. It can be shown that because the flow in the pipe is normally well developed, with the higher velocity flow being at the center of the pipe, the lower velocity water at the periphery of the flow cross section will of course have less momentum, and therefore more readily make the turn at the elbow, whereas the inertia of the higher velocity center stream portion will result in that water proceeding to the far wall of the turn of the elbow. The net effect is that two counter rotating eddies are generated by the elbow which, unless quite distant from the laminar flow nozzle, will provide not the relatively uniform velocity flow into the nozzles as suggested by FIGS. 3, 5 and 6, but rather a flow having relatively high and localized disturbances therein. In the present invention, these disturbances are given a maximum amount of time to die out in the plenum 17, and of course because of their localized nature, they will die out reasonably quickly, though in the prior art it would appear that this disturbed flow too quickly proceeds on through the nozzle, because of the nonuniformity of flow rates therein, to naturally die on its own accord, at least to the same extent as in the present invention.

Finally, of course, normally laminar flow nozzles for the fountains and the like are mounted so that the stream 16 projects upward into the air, typically at some angle. With this physical orientation of the nozzle, one can avoid the placement of an elbow very close to the nozzle in the configurations of the present invention and in that of FIG. 6, though the configuration of FIG. 5 makes this most difficult as the inlet pipe will have to extend well into the ground unless at least one elbow is positioned relatively close to the nozzle.

Figure 4:
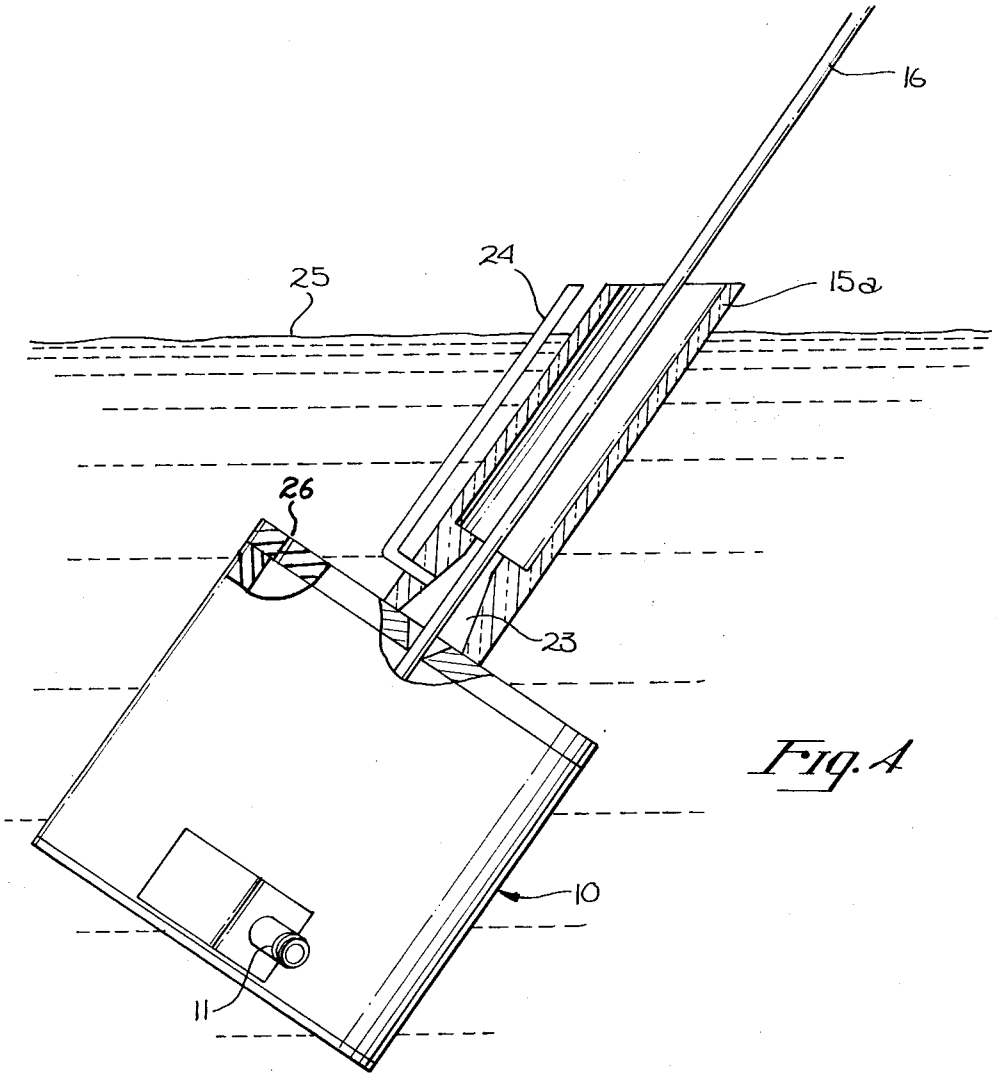
FIG. 4 is a side view of the present invention.

Now referring to FIG. 4, an alternate form of shield for the laminar flow nozzle may be seen. In particular, the system illustrated in FIG. 1 works very well, though if the extension 15 becomes swamped or otherwise filled with water, the system will tend not to clear itself, particularly at start up. Accordingly, special precautions may be required to avoid getting any water into the extension 15 or alternatively, to carefully remove all such water before operating the nozzle. The extension **15*a* of FIG. 4 however, is formed at the lower end thereof to have a sort of entrainment cavity 23 vented to the atmosphere through a separate vent tube 24, also extending above the surface of the water 25. The net effect of this is that even if the entire extension 15*a* and vent 24 become filled with water from rain or otherwise, on start up the stream 16 will entrain the water in region 23 and carry the same with it. This in turn will reduce the pressure in chamber 23, drawing the water downward out of the vent 24 for entrainment by the stream, the vent 24 ultimately providing a vacuum break to prevent suction in that region from holding the water in extension 15*a*. As a result, the stream 16 will first expel a good part of the water from extension 15*a* by effectively pushing it out, with the remaining water, to the extent it would touch and thereby effect the stream 16, being entrained by the stream and carried out therewith. Thus the configuration of FIG. 4, even if filled with water on start up will quickly automatically clear itself Also to facilitate startup, or at least initial startup, a small hole or vent 26 is positioned at the highest point of the tank 10** as installed. This will not cause significant loss of water, but will allow the automatic bleeding out of any air in the tank which might otherwise disturb the flow therein, and the compressibility of which may give rise to undesired pressure and flow fluctuations in and from the nozzle.

Thus there has been described herein a new and unique laminar flow nozzle which utilizes a tangential water inlet to result in flow conditions within the nozzle more conducive to the reduction of flow disturbances within the nozzle to result in a substantially improved laminar flow output stream therefrom. Obviously while various types of flow straightening, flow developing, and rotational flow removing devices have been disclosed and described herein with respect to the preferred embodiment, it will be understood by those skilled in the art that various changes in form and detail may be made therein without departing from the spirit and scope of the invention.

I claim:

1. A device for producing a laminar glass rodlike output stream of sufficient velocity for use in water displays comprising:

an enclosure means having an inlet port and an outlet orifice and defining a flow path between said inlet port and said outlet orifice, said outlet orifice having a flow area which is no more than a small fraction of the area of the flow path within said enclosure means and being a substantially sharp edge orifice constituting a step reduction in flow area from the area of the flow path within said enclosure means said enclosure means being a means for containing a volume of fluid under pressure for producing said output stream;

turbulence reducing means disposed within said enclosure means between said inlet port and said outlet orifice, said turbulence reducing means being a means for defining a large plurality of small area flow paths across the flow area between said inlet port and said outlet orifice for reducing rotational flow and turbulence in said enclosure means and for developing laminar flow in said enclosure means by reducing the Reynolds number of the flow of said fluid within said enclosure means;

means for removing any air from said enclosure means and said turbulence reducing means;

said inlet port for introducing said fluid to said enclosure means being mounted substantially tangentially to said enclosure means such that said fluid is introduced to said enclosure means substantially tangential to said enclosure means for subsequent passage through said enclosure means and out said outlet orifice.

2. The device of claim 1 wherein said enclosure means comprises a cylindrical tank.

3. The device of claim 2 wherein said outlet orifice consists of an orifice in one end wall of said tank and substantially concentric therewith.

4. The device of claim 3 wherein said inlet port is adjacent the end wall opposite said orifice.

5. The device of claim 1 wherein said turbulence reducing means comprises an open cell foam member and a flow straightening member having a plurality of straight and parallel flow passages therethrough.

6. The device of claim 5 wherein said porous foam member is disposed in said enclosure to receive flow progressing from said inlet port for passage therethrough, said flow straightening member being positioned between said foam member and said outlet orifice.

7. A device for producing a laminar glass rod-like output stream of sufficient velocity for use in water displays comprising:

a cylindrical enclosure means having first and second ends, and having an inlet port adjacent said first end and an outlet orifice in said second end, and defining a flow path between said inlet port and said outlet orifice, said outlet orifice having a flow area which is no more than a small fraction of the area of the flow path within said enclosure means and being a substantially sharp edge orifice constituting a step reduction in flow area from the area of the flow path within said enclosure means, said enclosure means being a means for containing a volume of fluid under pressure for producing said output stream;

turbulence reducing means disposed within said enclosure means between said inlet port and said outlet orifice, said turbulence reducing means being a means for defining a large plurality of small area flow paths in the flow area between said inlet port and said outlet orifice for reducing rotational flow and turbulence in said enclosure means and for developing laminar flow in said enclosure means by reducing the Reynolds number of the flow of said fluid within said enclosure means;

means for removing any air from said enclosure means and said turbulence reducing means; and said inlet port for introducing said fluid to said enclosure means enclosure means being mounted substantially tangentially to said enclosure means such that said fluid is introduced to said enclosure means substantially tangential to said enclosure means for subsequent passage through said enclosure means and out said outlet orifice.

8. The device of claim 7 wherein said outlet orifice is substantially concentric with said cylindrical enclosure

9. The device of claim 8 wherein said turbulence reducing means comprises an open cell foam member and a flow straightening member having a plurality of straight and parallel flow passages therethrough.

10. The device of claim 9 wherein said porous foam member is disposed in said enclosure to receive flow progressing from said inlet port for passage therethrough, said flow straightening member being positioned between said foam member and said outlet orifice.

11. A method of producing a laminar stream comprising the steps of (a) providing an enclosure means having an inlet port and an outlet orifice and defining a flow path between said inlet port and said outlet orifice, said outlet orifice having a flow area which is no more than a small fraction of the area of the flow path within said enclosure means and being a substantially sharp edge orifice constituting a step reduction in flow area from the area of the flow path within said enclosure means, said enclosure means being a means for containing a volume of fluid under pressure for producing the output stream;

(b) providing turbulence reducing means disposed within the holding means between the inlet port and the outlet orifice, the turbulence reducing means being a means for defining a large plurality of small area flow paths across the flow area between the inlet port and the outlet orifice for reducing rotational flow and turbulence in the enclosure means for developing laminar flow in the enclosure means by reducing the Reynolds number of the flow of the fluid within the enclosure means;

(c) removing all air from the enclosure means and the turbulence reducing means; and (d) pressurizing the enclosure means by introducing fluid through an inlet port to the enclosure means substantially tangentially to the enclosure means for subsequent passage through the enclosure means and out the outlet orifice.

* * * * *